US006440016B1

(12) United States Patent
Chang

(10) Patent No.: US 6,440,016 B1
(45) Date of Patent: Aug. 27, 2002

(54) RACKET OF A METAL TUBE COMBINED WITH FIBER MATERIAL

(76) Inventor: Chen-Chung Chang, No. 912, Chung Shang Rd., Shen Kang, Taichung Hsien, 429 (TW)

( * ) Notice: Subject to any disclaimer, the term of this patent is extended or adjusted under 35 U.S.C. 154(b) by 0 days.

(21) Appl. No.: 09/855,550

(22) Filed: May 16, 2001

(51) Int. Cl.[7] ..... A63B 49/12
(52) U.S. Cl. ..... 473/545; 473/535
(58) Field of Search ..... 473/545, 544, 473/547, 524, 535, 536

(56) References Cited

U.S. PATENT DOCUMENTS 5,935,028 A * 8/1999 Lo ..... 473/535

FOREIGN PATENT DOCUMENTS

JP 8-155056 * 6/1996 ..... A63B/49/02

* cited by examiner

*Primary Examiner*—Raleigh W. Chiu
(74) *Attorney, Agent, or Firm*—Troxell Law Office PLLC

(57) ABSTRACT

A racket of a metal tube combined with fiber material includes a metal frame having a hollow interior and two free ends with sloped end surfaces respectively inserted in with an air-filling tube wrapped around with a carbon fiber layer of a preset thickness, forming a length-preset connecting portion in the metal frame. Then, this metal frame is put in a mold and air is compressed into the air-filling tubes to expand them and at the same time fill up the entire mold chamber and the connecting portion in the metal frame and subsequently thermally solidified in shape, thus obtaining a racket of a metal tube combined with fiber material, possible to reinforce its structure and reducing shock caused by striking balls.

3 Claims, 3 Drawing Sheets

RACKET OF A METAL TUBE COMBINED WITH FIBER MATERIAL

BACKGROUND OF THE INVENTION

This invention relates to a racket of a metal tube combined with fiber material, particularly to one possible to reinforce the structure of a racket and prevent the racket from splitting.

A conventional racket, as shown in FIG. 1, includes a metal frame 1 assembled fixedly with a handle 2 by winding plural fiber-woven layers 3 around an interconnecting portion, and then placed into a mold to be thermally solidified in shape by compressing the mold to obtain a racket.

However, the conventional racket made in a way of winding fiber-woven layers around the interconnecting portion of the metal frame and the handle for fixing in place is liable to split in the direction vertical to the striking one due to insufficient strength of the interconnecting portion, thus having high discard percentage, increasing expense to consumers and possibly unsafe in playing.

SUMMARY OF THE INVENTION

The objective of the invention is to offer a racket of a metal tube combined with fiber material, consisting of a metal frame having a hollow interior, two free ends with sloped end surfaces respectively connected with two air-filling tubes wrapped with a fiber layer of a preset thickness, forming a connecting portion of a predetermined length inside the metal frame. Then, the racket frame is placed into a mold, and air is compressed into the air-filling tubes to expand the air-filling tubes outward and at the same time fill up the entire mold chamber and the connecting portion in the metal frame, and then thermally solidified in shape to finish a racket of a metal tube combined with fiber material, possible to elevate its quality, lighten its weight and lower shock caused by striking balls as well.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
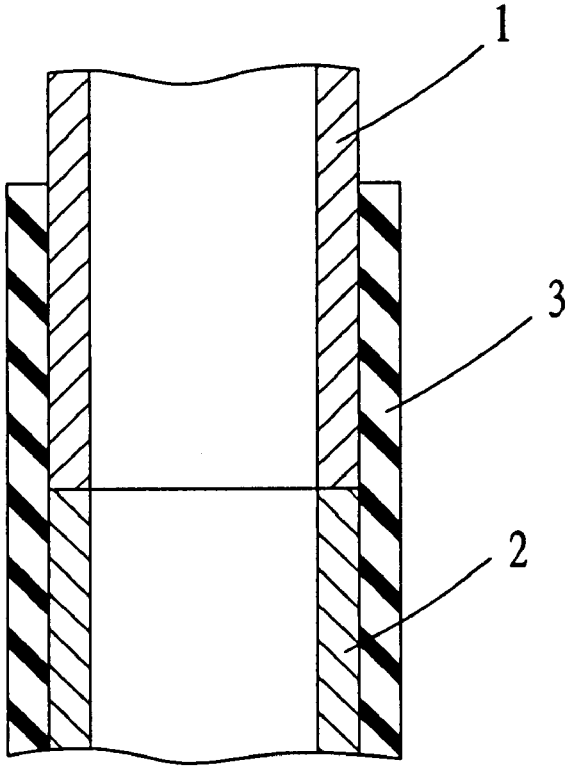
FIG. 1 PRIOR ART
FIG. 1. is a cross-sectional view of an interconnecting portion of a conventional racket.
Figure 3:
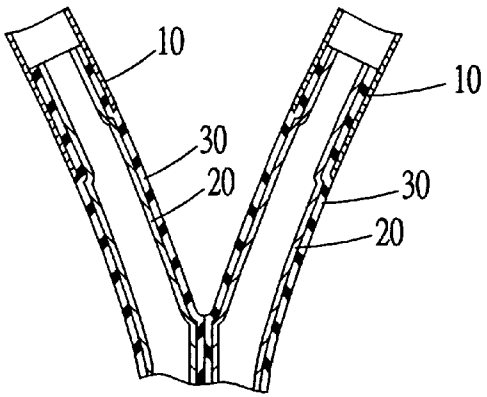
FIG. 3 is a cross-sectional view of a connecting portion of a metal frame and two air-filling tubes in the present invention.
Figure 2:
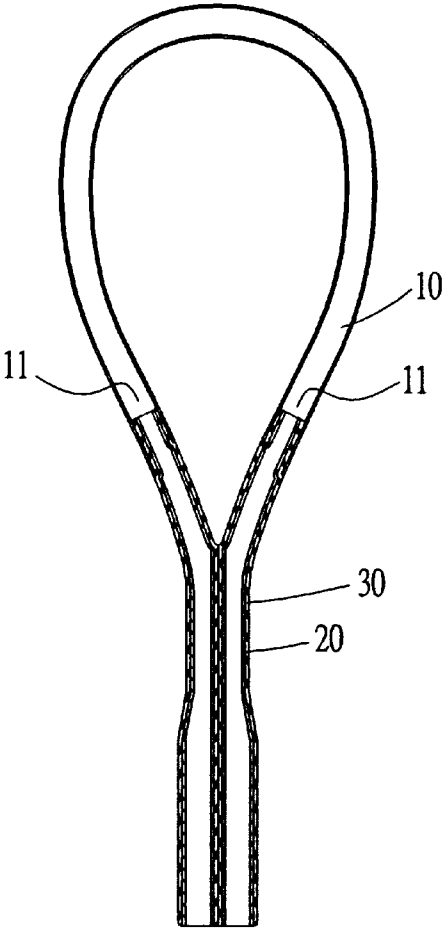
FIG. 2 is a cross-sectional view of a racket in the present invention.

A preferred embodiment of a racket of a metal tube combined with fiber material, as shown in FIGS. 1 and 2, includes a metal frame 10, two air-filling tubes 20 and a carbon fiber layer 30 of a preset thickness as main components combined together.

The metal frame 10 is made of metallic material of a hollow interior, bent in a preset arc shape and having two free ends 11 respectively with a sloped end surface. Two air-filling tubes 20 have respectively an inner end inserted in the metal frame 10 through each free end 11 and each inner end is closed.

The fiber layer 30 is made of carbon fiber or the like and wrapped around a predetermined portion of the outer surface of each air-filling tube 20.

Figure 4:
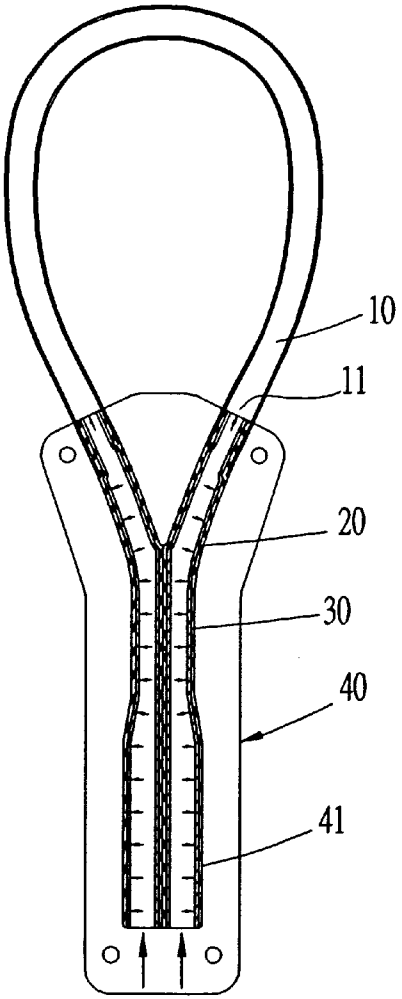
FIG. 4 is a cross-sectional view of the racket placed in a mold in a condition of compressing air into the air-filling tubes in the present invention.

The process of making a racket according to this invention, as shown in FIG. 4, is described below.

The metal frame 10 of a hollow interior, bent in a preset arc shape, and having two free ends 11 with sloped end surfaces is first prepared, and the air-filling tubes 20 are respectively inserted in each free end 11 of the metal frame 10, having the two ends closed up and further having the outer surface wrapped with the carbon fiber layer 30 of a preset thickness around a predetermined portion, and this fiber layer 30 extends into the free ends of the metal frame to a preset length to form the connecting portion inside.

Next, the metal frame 10 combined with the two air-filling tubes 20 is wrapped with the carbon fiber layer 30 and then placed in a mold 40, which has a mold chamber 41 shaped as the handle of the racket, and after that, air is compressed into two air-filling tubes 20 to expand the same tubes 20 outward to fill up the entire mold chamber 11 and the connecting portion in the metal frame 10, and then thermally solidify the air-filling tubes 20, making the air-filling tubes 20 together with the fiber layer 30 solidified in shape, and accordingly acquiring a racket of a metal tube combined with fiber material.

Figure 5:
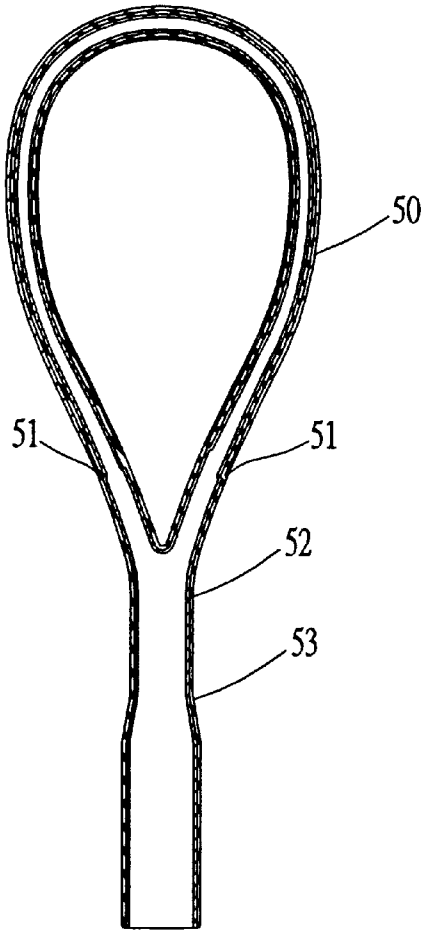
FIG. 5 is a cross-sectional view of another embodiment of the racket in the present invention.

Another embodiment of a racket of a metal tube combined with fiber material in this invention, as shown in FIG. 5, includes a metal frame 50 having two free ends 51 combined with an air-filling tube 52 which is fully wrapped with a carbon fiber layer 52 of a preset thickness, The upper end of the air-filling tube 52 is entirely inserted in the metal frame 50 through the free ends 51 for a predetermined length, Then, the metal frame 50 is placed in a mold 54 and air is compressed into the air-filling tube 52 to expand the air-filling tube 52 together with the fiber layer 53 and then thermally solidified in shape to finish a racket with a hollow interior combined with the fiber layer 53, capable to strengthen its entire structure.

Furthermore, the combination of the components and the advantages of the invention are specifically described below.

1. The racket is made of metallic material with a hollow interior and has two free ends with sloped end surfaces. The two air-filling tubes wrapped with fiber layer of preset thickness are respectively inserted in each free end of the metal frame, forming a connecting portion inside the metal frame. Then, this metal frame is put into a mold and the air-filling tubes are filled with air by compression to expand the air-filling tubes and also to fill up the entire mold chamber and the connecting portion in the metal frame and subsequently thermally solidified in shape to finish a racket of a metal tube combined with fiber material. Made in such a way, it is possible to reinforce the structure of a racket, to lighten the weight and to lower shock caused by striking balls.
2. The sloped end surface of each free end of the metal frame is capable to increase the area of combination of the metal frame and the fiber layer so as to make them combined tightly and stably. Besides, the comparatively large area of the sloped end surfaces may disperse the stress produced by striking ball s, thus lowering the average force imposed on the sloped end surfaces of the combination and preventing the racket from splitting.
3. After solidified in a mold, the metal frame together with the fiber layer is shaped like a Y and two engage portions are at the expanding-out sections of the Y not positioned in parallel, thus letting the two opposite connecting portions resisting against each other. And further, the way of compressing air into the two air-filling tubes to let them thermally solidified in shape allows the metal frame and the carbon fiber layer combined together tightly, impossible to give rise to disconnection.

While the preferred embodiments have been described above, it will be better recognized and understood that various modifications may be made therein and the appended claims are intended to cover all such modifications that may fall within the spirit and scope of the invention.

I claim:

1. A racket of a metal tube combined with fiber material comprising:

A metal frame having a hollow interior and two free ends, bent in a preset arc shape;

Two air filling tubes respectively having an upper end inserted in each said free end of said metal frame; and, A carbon fiber layer wrapping a preset portion of each said air-filling tube, said fiber layer extending into each said free end of said metal frame to a preset length to form a connecting portion thermally solidified in shape so as to render said fiber layer and said metal frame combined together tightly.

2. The racket of a metal tube combined with fiber material as claimed in claim 1, wherein said air-filling tube wrapped with a carbon fiber layer of a preset thickness can be fully inserted into the entire hollow interior of said metal frame.

3. The racket of metal tube combined with fiber layer as claimed in claim 1, wherein said two free ends of said metal frame are respectively shaped in a sloped end surface.

* * * * *